United States Patent [19]

Kneissl

[11] 4,023,606

[45] May 17, 1977

[54] ICE AX, AND METHOD AND EXTRUSION APPARATUS FOR THE MANUFACTURE THEREOF

[76] Inventor: Franz Kneissl, Aug. Scherlstrasse 12, Kufstein, Austria

[22] Filed: Feb. 5, 1976

[21] Appl. No.: 655,356

[30] Foreign Application Priority Data

Feb. 5, 1975 Austria ..... 851/75

[52] U.S. Cl. ..... 145/2 R; 145/61 H

[51] Int. Cl.² ..... B25G 1/10

[58] Field of Search ..... 7/8.1 R; 30/164.5, 164.8, 30/340–343; 125/40, 43; 145/2 R, 61 C, 61 H

[56] References Cited

UNITED STATES PATENTS

| | | | |
|---|---|---|---|
| 1,685,588 | 9/1928 | Hemming | 30/343 X |
| 1,728,619 | 9/1929 | Lambert | 30/343 X |
| 3,114,973 | 12/1963 | Kennedy | 30/342 |
| 3,712,659 | 1/1973 | Kneissl | 145/61 C X |
| 3,735,434 | 5/1973 | Penberthy | 145/2 R X |
| 3,770,033 | 11/1973 | Gavillet et al. | 145/61 C |

*Primary Examiner*—Al Lawrence Smith
*Assistant Examiner*—James G. Smith
*Attorney, Agent, or Firm*—Bacon & Thomas

[57] ABSTRACT

Disclosed is an ice ax comprising a pickax blade, a pickax spur, a handle projecting transversely from the blade connecting the spur and the blade and having a plastic jacket of oval cross section defining a core area of foamed plastic material and means for permanent and rigid anchoring of the blade to the handle whereby a segment of the anchoring means passes through the handle core and rigidly joins another segment of the anchoring means extending from the blade. A method for the manufacture of the ice ax and an apparatus for the extrusion of the plastic jacket and foam core of the ax handle are also disclosed.

10 Claims, 5 Drawing Figures

ICE AX, AND METHOD AND EXTRUSION APPARATUS FOR THE MANUFACTURE THEREOF

Figures 1, 2:
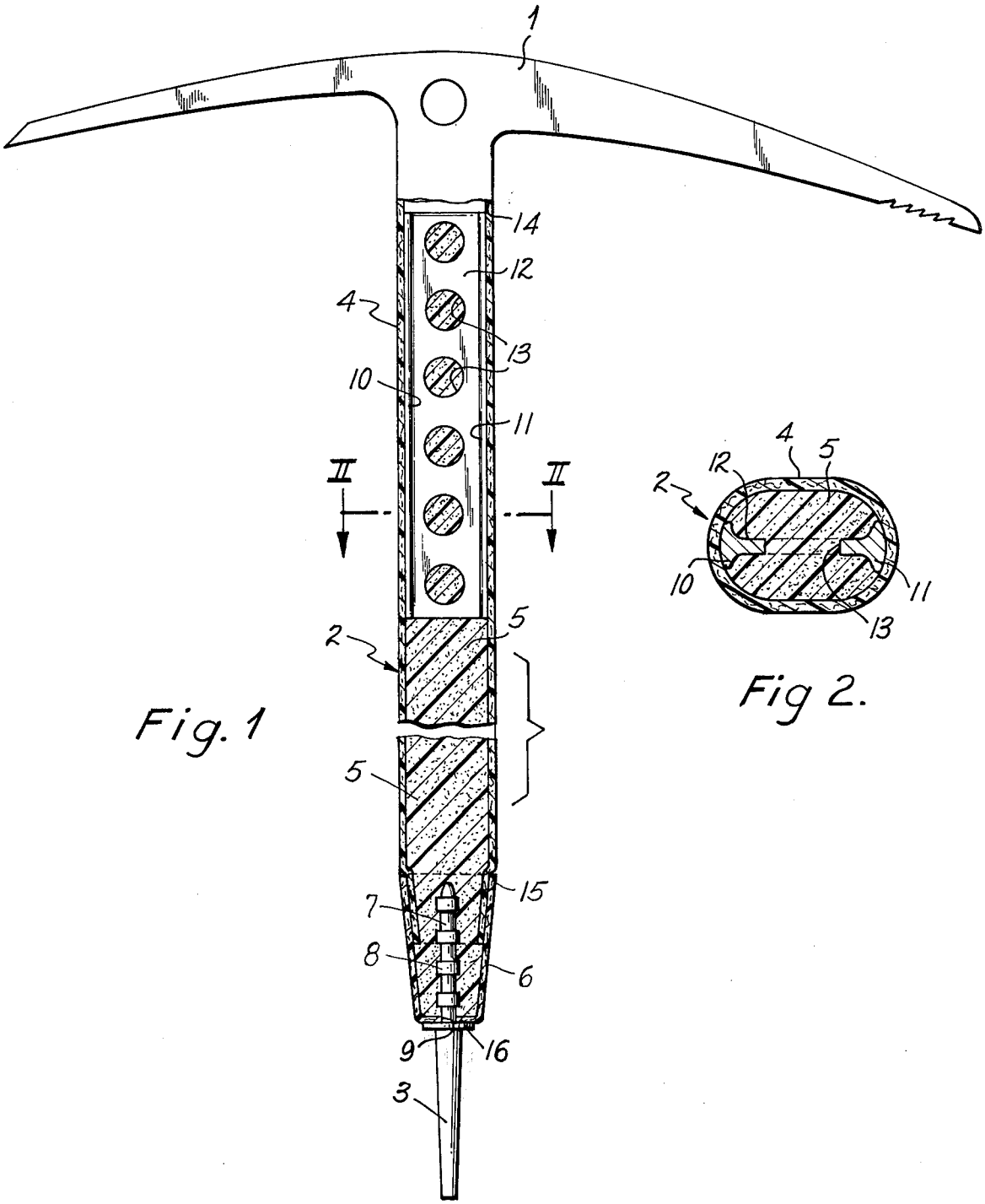

The invention relates generally to ice axes and more particularly to ice axes of the type used by mountain climbers. In one particular embodiment of the invention, to an ice ax is disclosed which comprises a pickax blade, a pickax spur, and a straight handle, connecting spur and blade, which handle projects transversely from the blade, presents an oval cross section, and consists of a light core as well as of a fiber-reinforced plastic jacket, the blade being inflexibly anchored to the handle by means of two extensions passing along the two curvature peaks of the handle cross section beneath the jacket.

In the hitherto known ice axes of this modern type, the extensions of the blade were anchored to the wooden handle in such a way that the two extensions were riveted together transversely through the intermediate handle wood and were thus joined together so as to form an inflexible unit. Subsequently, the device was protected against water and against mechanical attack by the application of the plastic jacket. As known from experience, the wooden hangle core, after having been in use for some length of time, gradually begins to shrink, whereby the inflexible connection of the blade extensions is loosened and moisture can enter under the plastic jacket and penetrate to the riveting areas, so that frequently rust was formed which led to further loosenings.

It is the purpose of the invention to improve the ice ax of the initially mentioned kind in such a manner that, while its known advantages are retained, the inflexible connection between pickax handle and blade is preserved even after a heavy stress of long duration. An advantageous embodiment of the invention consists in that the blade extensions are connected by means of a thin bridge which passes through the handle core, and in that the handle core consists of foam plastic. In this manner a permanent and rigid anchoring of the blade and handle is achieved.

The connection of the two anchoring extensions of the blade through a thin bridge which, like the extensions themselves, may be integral with the blade, assures at once an inflexible connection between the extensions, which cannot be loosened even by rust and cannot weaken the handle core any more than the conventionally employed rivet connection. The fact that the handle core is made of foam plastic permits in such structure an intimate embedding of the thin bridge in the handle material, excludes any shrinkage phenomena and does not leave the handle exposed to changes, even when water enters. On the whole, the invention results in considerable labor savings in the manufacture of the ice ax and therefore in a substantial reduction in cost.

In an advantageous refinement of the invention, the thin iron bridge is provided with recesses or projections for the anchoring in the foam plastic core. When the plastic material is foamed in situ, it can by itself fill these recesses or, respectively, envelop the projections.

In the known method for manufacturing an ice ax of the initially mentioned type, a glass-fiber-reinforced plastic jacket is manufactured for the handle. For this purpose, the wooden handle was conventionally firmly connected with the blade and the spur, and covered with the plastic jacket. In the manufacture of the ice ax of the invention, on the other hand, the procedure according to the invention is the following: According to the invention, the plastic jacket is manufactured separately as an oval tube, and a cup-shaped sealing case, provided with an opening in the center, is made for the jacket end that faces the spur. Then the tubular jacket is joined, on one side, to the sealing cup, and on the other side to the blade and is held in this position while for the manufacture of the handle core foam plastic is pressed-in through the center opening of the sealing case until all hollow spaces are completely filled with foam, whereafter the spur, provided with its customary anchoring notches or the like, is pressed as sealing device into the center opening, and the hardening of the foam core is waited for. This method saves practically any reworking of the crude constituents of the ice ax and is therefore eminently suitable for industrial mass production.

To carry out the method of the invention, an extrusion apparatus has been produced, characterized essentially by heads displaceable by way of longitudinally parallel guides; one of the said heads being intended for supporting the blade, and another for supporting the sealing case and for supplying the foam plastic to the center opening thereof; and further characterized by jaws which can be closed transversely to the guides, so as to laterally support at least the flat sides of the oval plastic jacket. In the preferred embodiment of this extrusion apparatus, the head that supports the sealing case is provided with a receiving and a lifting device for pressing the spur into the center opening of the foam-filled sealing case.

Figure 3:
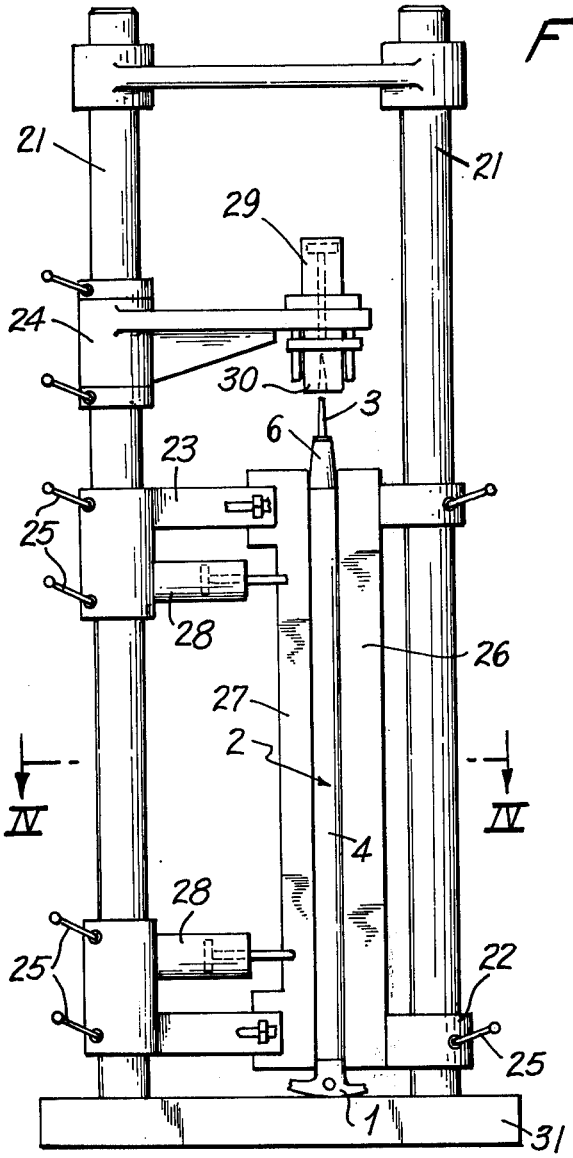
Figure 5:
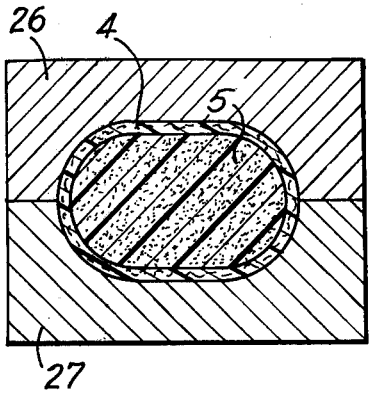
Figure 4:
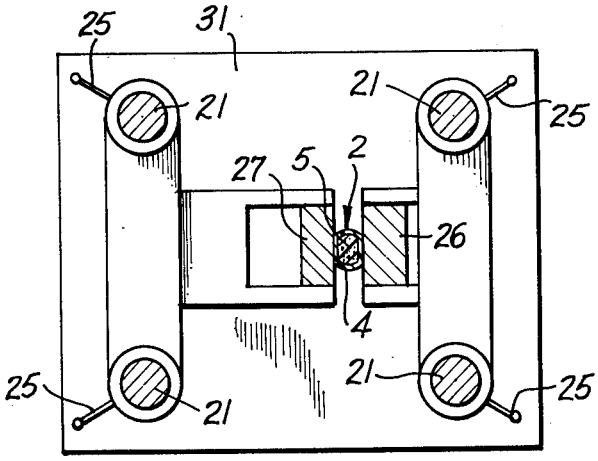

The invention is described in the following with the aid of the drawing. FIG. 1 shows an ice ax according to the invention in longitudinal section; FIG. 2, a cross section through the handle along line II —II of FIG. 1. FIG. 3 shows an extrusion apparatus according to the invention in elevation, with inserted pickax element. FIG. 4 shows this apparatus in plan view and partly in section along line IV —IV of FIG. 3. FIG. 5 shows on a larger scale a modified cross section of the jaws of the apparatus, with pickax handle inserted.

The ice ax shown in FIG. 1 consists essentially of a two-armed pickax blade 1, a pickax handle 2 anchored thereto, and a pickax spur 3 mounted on the free handle end. Handle 2 consists, according to FIG. 2, of a tubular jacket 4 with oval tube cross section, and a handle core 5 which fills this cross section. Handle jacket 4 consists preferably of a glass-fiber-reinforced plastic material and in reinforced at the handle end that faces the spur by a preferably metallic sealing case 6 having the shape of a cup. Spur 3 is inserted, by means of a shaft 8 provided with notch grooves 7, in a sealing case 6 through a center opening 9 thereof and anchored to handle core 5. If notch grooves 7 are thread-shaped, spur 3 can be screwed off from handle 2.

Blade 1 has two extensions 10, 11, which protrude, along the opposite curvature peaks of the oval tubular jacket, into this jacket and are connected through a thin bridge 12 transversely through handle core 5. This thin bridge 12 is provided with spaced recesses 13 by means of which it anchors the blade firmly in the core material 5 of handle 3. Core material 5 is foam plastic.

Blade 1 is provided, at the beginning of its extensions 10, 11 with a shoulder 14 fitted to hold the end of tubular jacket 4 that faces the blade. At the end that faces the spur, tubular jacket 4 is provided with a shoulder 15, fitted to support sealing case 6; and spur 3 is provided, at the beginning of its shaft 8, with an abutment washer 16 for supporting the spur on sealing case 6. In the manufacture of the ice ax, blade 1 is inserted, up to shoulder 14, in tubular jacket 4; sealing case 6 is slipped-on up to shoulder 15, and through center opening 9 the entire core space is filled, under pressure, with foam plastic. Finally, the spur is pressed into center opening 9 up to abutment washer 16, and then the hardening of the foam core is waited for. Then the ice ax is finished.

This manufacturing process is suitably carried out by means of the apparatus shown in FIGS. 3 and 4. The latter consists essentially of four parallel vertical guides 21, and heads 22, 23, 24, displaceable along these guides and lockable thereon by means of clamp levers 25. Heads 22 and 23 bear jaws 26, 27, facing each other, which can be opened and closed by piston mechanism 28 engaging one jaw 27. Head 24 bears a further piston mechanism 29, as well as a socket 30 for a spur 3, this socket 30 being adjustable, by means of the said piston mechanism 29, in the direction of guides 21.

According to FIG. 3, the crude parts of an ice ax according to the invention are assembled and placed into the apparatus in such a manner that blade 1 rests on the base plate 31 of the apparatus, the oval tubular jacket 4 is held between jaws 26, 27; and spur 3 is aligned to socket 30. Jaws 26, 27 can, either according to FIG. 4, support with flat working surfaces the flat sides only of oval tubular jacket 4, or according to FIG. 5, by corresponding recesses, the entire jacket periphery.

After the closing of jaws 26, 27, spur 3 is removed and socket 30 is held, by means of piston mechanism 29, against the sealing case 6 of tubular jacket 4, and foam plastic is injected, by means of a supply line not shown, through socket 30 and center opening 9 of sealing case 6 into tubular jacket 4. The excess pressure thus produced is absorbed by jaws 26, 27, and thereby the oval shape of tubular jacket 4 is retained. By sockets and shoulders 14, 15, provided at the assembly gaps of the ice ax parts, the discharge of plastic is efficiently prevented. After complete foaming, socket 30 is lifted by means of piston mechanism 29, spur 3 is inserted in socket 30 and is by means of piston mechanism 29 pressed into the center opening 9 of sealing case 6 until abutment washer 16 rests against the base of the sealing case. After the time required for hardening of foam plastic 5, jaws 26, 27 are opened by means of piston mechanism 28, and socket 30 is lifted by means of piston mechanism 29, whereafter the finished ice ax is removed from the apparatus.

The plastic jacket assures the gripping traction warm to touch desired by the mountain climber, and moreover, the foam plastic core assures a particularly low handle weight which, circumstances permitting, makes possible the use of a correspondingly heavier blade 1.

I claim:

1. An ice ax comprising:
a pickax blade,
a pickax spur;
a handle projecting transversely from said blade connecting said spur and said blade and having a plastic jacket of oval cross section defining a core area of foamed plastic material, and
a pair of rigid members, each member being fixedly attached to said blade and extending opposite one another lengthwise from said blade along the inside surface of the curvature peaks of the oval cross section of said jacket and being connected by a rigid bridge member extending through said core and being of substantially smaller volume than the volume of said core area.

2. The ice ax of claim 1 having a means for anchoring said bridge member in said foamed plastic material.

3. The ice ax of claim 2 wherein said bridge anchoring means comprises recesses in the rigid bridge member, said recess being in intimate communication with said foamed plastic material.

4. The ice ax of claim 2 wherein said bridge anchoring means comprises projections extending from said rigid bridge member into intimate communication with said foamed plastic material.

5. The ice ax of claim 1, wherein said plastic jacket comprises a fiber-reinforced plastic material.

6. The ice ax of claim 1, wherein said rigid members extending from said blade are integral with said blade.

7. The ice ax of claim 6, wherein said rigid members extending from said blade are integral with said bridge member.

8. The ice ax of claim 1, wherein said rigid members are comprised of the same material as said blade.

9. The ice ax of claim 1, wherein said blade has, at the beginning of said extension sections, a shoulder fitted to hold the end of said plastic jacket facing said blade.

10. The ice ax of claim 1, wherein said plastic jacket has at the end that faces said spur, a shoulder fitted to support a sealing case which supports said spur.

* * * * *